US005219102A

United States Patent [19]

Wright

[11] Patent Number: 5,219,102

[45] Date of Patent: Jun. 15, 1993

[54] FOAMING DEVICE

[75] Inventor: H. Earl Wright, Decatur, Ill.

[73] Assignee: Earl Wright Company, Decatur, Ill.

[21] Appl. No.: 869,861

[22] Filed: Apr. 16, 1992

Related U.S. Application Data

[63] Continuation of Ser. No. 504,944, Apr. 5, 1990, abandoned.

[51] Int. Cl.[5] ..... B67D 5/58

[52] U.S. Cl. ..... 222/190; 222/189; 222/211; 222/212; 222/522

[58] Field of Search ..... 222/189, 190, 211, 212, 222/464, 481.5, 482, 484, 522, 523, 531, 402.18; 239/343, 327

[56] References Cited

U.S. PATENT DOCUMENTS

| | | | |
|---|---|---|---|
| 3,341,130 | 9/1967 | Weber | 239/327 |
| 3,428,222 | 2/1969 | Wright | 222/187 |
| 3,709,437 | 1/1973 | Wright | 239/343 |
| 3,937,364 | 2/1976 | Wright | 222/190 |
| 4,018,364 | 4/1977 | Wright | 222/190 |
| 4,024,992 | 5/1977 | Schmid | 239/327 X |
| 4,147,306 | 4/1979 | Bennett | 239/343 X |
| 4,184,615 | 1/1980 | Wright | 222/190 |
| 4,429,834 | 2/1984 | Ito | 239/327 |
| 4,509,661 | 4/1985 | Sugizaki et al. | 222/190 |
| 4,531,659 | 7/1985 | Wright | 222/190 |
| 4,615,467 | 10/1986 | Grogan et al. | 222/190 X |
| 4,836,422 | 6/1989 | Rosenberg | 222/190 |
| 4,880,161 | 11/1989 | Wright | 239/330 |

*Primary Examiner*—Gregory L. Huson
*Attorney, Agent, or Firm*—Philip L. Bateman

[57] ABSTRACT

A foam dispensing device mixes a foamable liquid with ambient air and dispenses a foam having a relatively constant ratio of liquid to air even during rapidly repeated foam dispension. The device contains a passage for foam return from a foam conduit to a liquid reservoir having one-way valve means to permit flow only in the direction from the foam conduit to the liquid reservoir during operation of the foamer, and a means of separating the inlet to the air passage from the outlet of the foam return passage to prevent flow of foam through the air passage during rapid, repeated foam dispension.

10 Claims, 3 Drawing Sheets

FOAMING DEVICE

CROSS-REFERENCE TO RELATED APPLICATION

This application is a continuation of U.S. patent application Ser. No. 07/504,944, filed Apr. 5, 1990, now abandoned.

FIELD OF THE INVENTION

This invention relates to foaming devices. More particularly, this invention relates to devices for generating a foam by mixing a foamable liquid with air, and for dispensing the generated foam.

BACKGROUND OF THE INVENTION

Devices for generating and dispensing foams by manual compression of a reservoir or bulb are well known. The compression typically forces air and foamable liquid from a reservoir into a mixing chamber where they mix to produce a foam before being dispensed from the device. Such devices are disclosed in a series of patents issued to H. Earl Wright: U.S. Pat. No. 3,428,222, issued Feb. 18, 1969; U.S. Pat. No. 3,709,437, issued Jan. 9, 1973; U.S. Pat. No. 3,937,364, issued Feb. 10, 1976; U.S. Pat. No. 4,018,364, issued Apr. 19, 1977; U.S. Pat. No. 4,184,615, issued Jan. 22, 1980; U.S. Pat. No. 4,531,659, issued Jul. 30, 1985; and U.S. Pat. No. 4,880,161, issued Nov. 14, 1989, each of which is incorporated by reference.

Most prior art foaming devices, including those disclosed in the Wright patents, share a number of common elements. Typically, each foamer contains a liquid reservoir for storing the foamable liquid. Each contains a compressible air supplying means. Each contains a mixing chamber where the foamable liquid and air mix to form the foam. Each contains a restricted passage from the air supplying means to the mixing chamber. Each contains a passage from the liquid reservoir to the mixing chamber, typically a vertical dip tube. And each contains some means for dispensing foam from the mixing chamber. As mentioned above, these foamers are all operated by compressing the air supplying means which forces air and foamable liquid into the mixing chamber. When the air supplying means is released, the vacuum created thereby draws foam from within the device back into the liquid reservoir.

The ratio of foamable liquid to air supplied to the mixing chamber is critical in foam formation in these devices. If the ratio is too high, the foam is too wet. If the ratio is too low, the foam is too dry. While the various Wright foamers are designed to maintain a fairly constant liquid-to-air ratio when compressed periodically, these foamers, and others known in the art, suffer from an alteration in the ratio with rapid, repeated usage. This feature can be visualized by reference to FIG. 3 of Wright, U.S. Pat. No. 3,709,437. Upon an initial compression of the reservoir, air flows through air passages 58, liquid flows through tubular member 38, and the two meet in the mixing chamber 42 where the foam is formed. When the reservoir is released, the ball check valve 60 seats and foam flows back through air passages 58. If the reservoir is immediately re-compressed, foam dripping down from the air passages will be forced back into the mixing chamber. The addition of foam through the air passages to the mixing chamber, rather than pure air, increases the ratio of liquid to air and results in the formation of an overly wet foam. Accordingly, there is a need for a foamer which maintains a constant liquid to air ratio during rapid, repeated usage.

SUMMARY OF THE INVENTION

The general object of this invention is to provide an improved foaming device. A more particular object of this invention is to provide a foaming device which maintains a constant liquid-to-air ratio during rapidly repeated foam dispension.

I have discovered a foam dispensing device for mixing a foamable liquid with ambient air and dispensing a foam having a relatively constant ratio of liquid to air even during rapidly repeated foam dispension. The device comprises: (a) a liquid reservoir adapted to contain a quantity of foamable liquid; (b) a compressible air supplying means adapted to supply air at superatmospheric pressure when compressed and to replenish its air supply when released; (c) a mixing chamber in which the foamable liquid from the liquid reservoir and the air from the air supplying means can mix to form a foam; (d) a means for dispensing the foam from the device; (e) a conduit for foam from the mixing chamber to the foam dispensing means; (f) a passage for liquid from the liquid reservoir to the mixing chamber; (g) a restricted passage for air from the air supplying means to the mixing chamber; (h) a passage for foam return from the foam conduit to the liquid reservoir having one-way valve means to permit flow only in the direction from the foam conduit to the liquid reservoir during operation of the foamer; and (i) means of separating the inlet to the restricted air passage from the outlet of the foam return passage to prevent flow of foam through the restricted air passage during rapid, repeated foam dispension so that the ratio of liquid to air in the dispensed foam remains relatively constant.

DETAILED DESCRIPTION OF THE INVENTION

Figure 1:
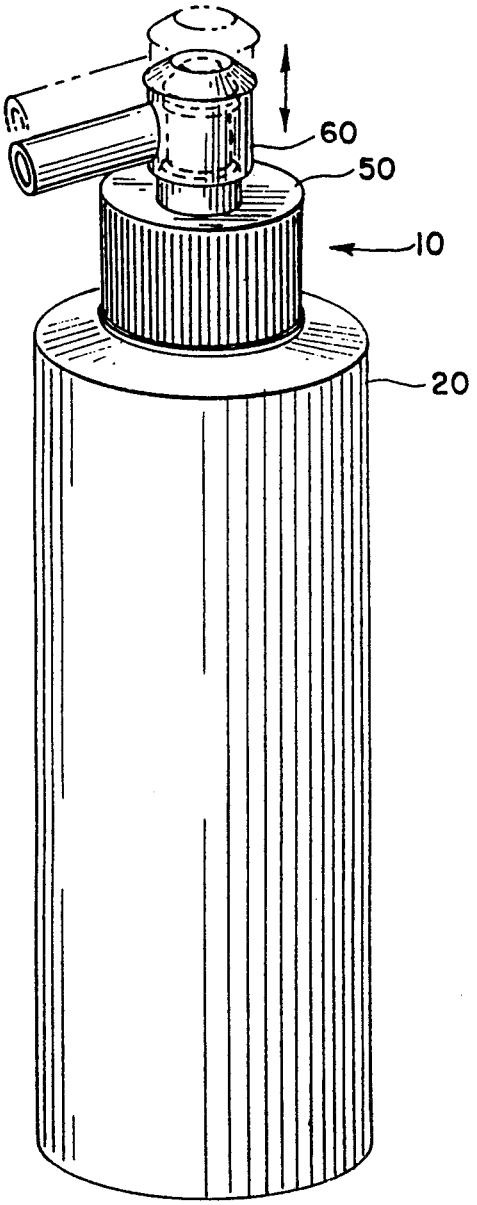
FIG. 1 is a perspective view of the foaming device of this invention.

This invention is best understood by reference to the drawings. FIG. 1 shows the foaming device 10 of this invention. Three of the components of the device are visible from the exterior, namely, the reservoir 20, the lid 50, and the cap spout 60, each of which is described in detail below.

The reservoir 20 is adapted to contain a quantity of a foamable liquid, such as liquid soap, and a quantity of air. The reservoir is flexible so that it can be easily squeezed by hand and has sufficient resiliency to return to its original shape when released. The volume of the reservoir is not critical, although sufficient squeezing to operate the device becomes difficult at volumes exceeding about one liter. The reservoir has a threaded neck portion 21 adapted to receive the foamer body and the lid discussed below.

Figure 2:
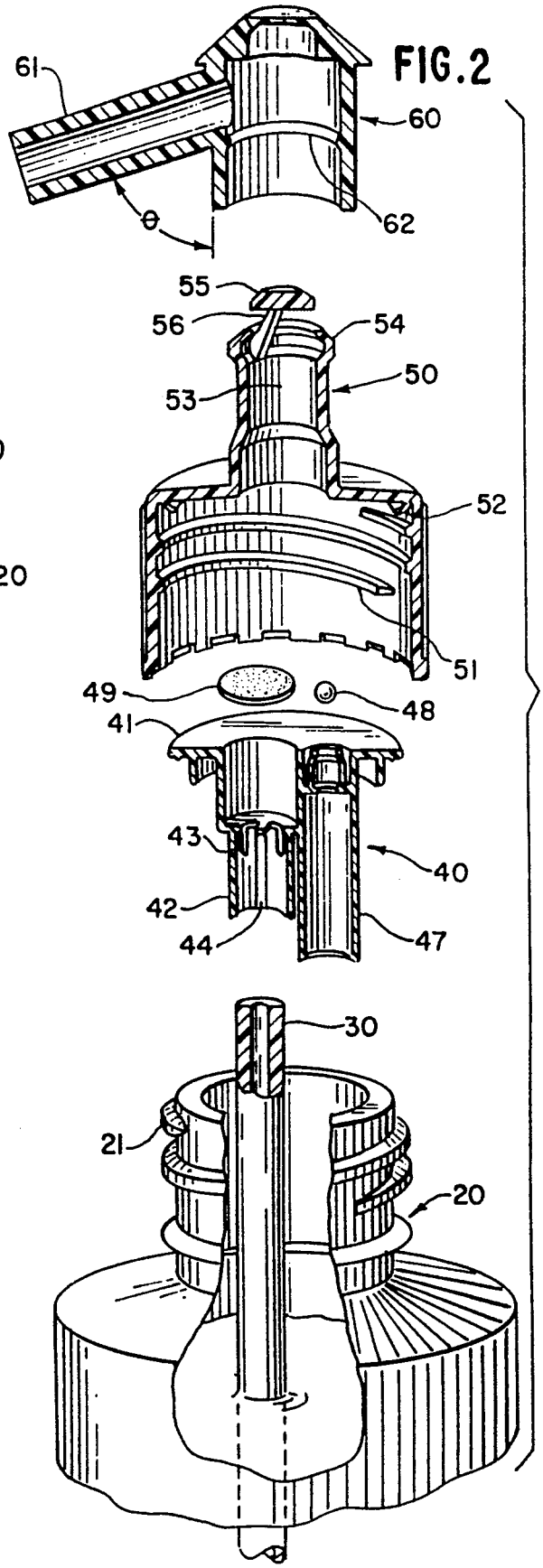
FIG. 2 is an exploded sectional view of the device.
Figure 3:
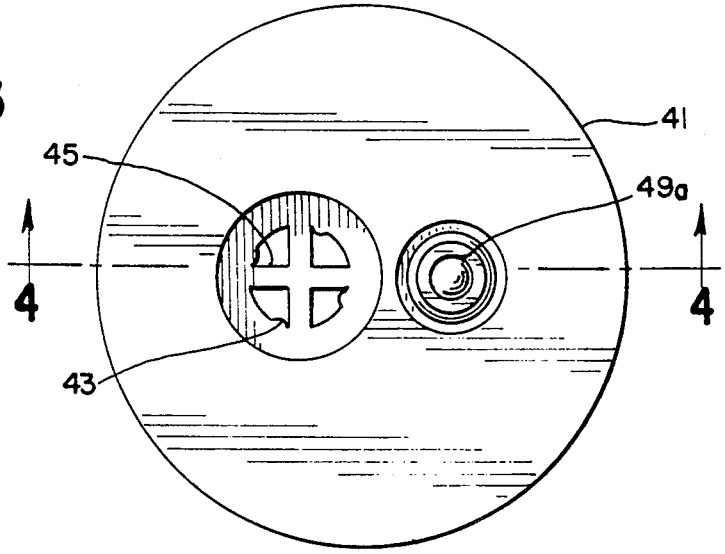
FIG. 3 is a top view of the foamer body of the device.

The foamer body 40 shown in FIG. 2 is shown in more detail in FIGS. 3, 4, 5, and 6. The foamer body fits on and into the top of the neck portion of the reservoir and is held in place by the lid. The foamer body comprises a thin circular disc 41 with two restricted conduits on the underside which communicate between the space above the foamer body (the interior of the lid) and the space below the foamer body (the interior of the reservoir).

Figure 6:
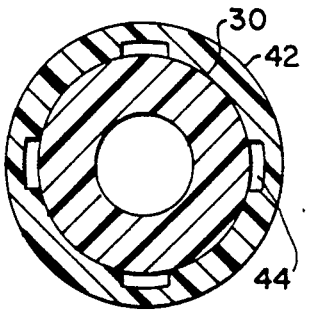
FIG. 6 is a section of the foamer body of the device along line 6—6 of FIG. 4.

The first restricted conduit is the foam providing passageway 42. The lower opening of the foam providing passageway is adapted to receive a liquid dip tube 30. Four protuberances 43 on the inside of the passageway limit the depth to which the dip tube is inserted. Four air channels 44 on the inside of the passageway permit the flow of air from the reservoir up and in between the passageway and the dip tube. The air channels are best seen in FIG. 6, which is a section of the foam providing passageway. The two cross members 45 in the passageway serve two purposes. First, they induce thorough mixing of the liquid and air at the point where the two come into contact at high velocities. Secondly, the cross members provide a base for an optional porous screen 49 which is positioned on top of the cross members and which helps produce a foam of uniformly-sized bubbles.

Above the two cross members is a recessed chamber 46 where additional mixing of the foam occurs. The term "mixing chamber" is used to describe the interior portion of the foaming device where the foam is formed.

Figure 4:
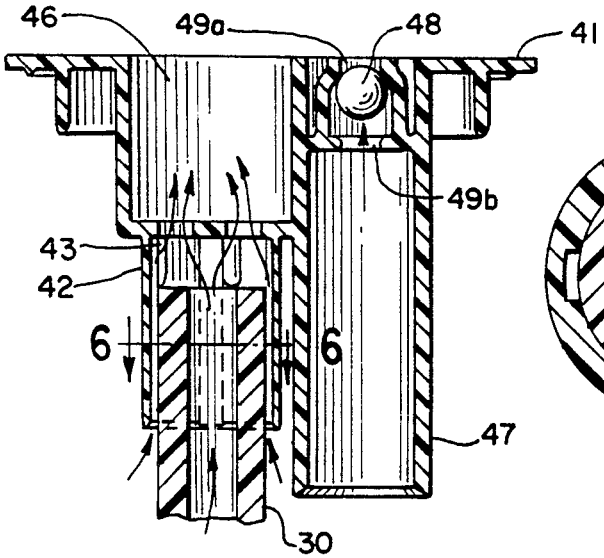
FIG. 4 is a sectional view of the foamer body of the device.
Figure 5:
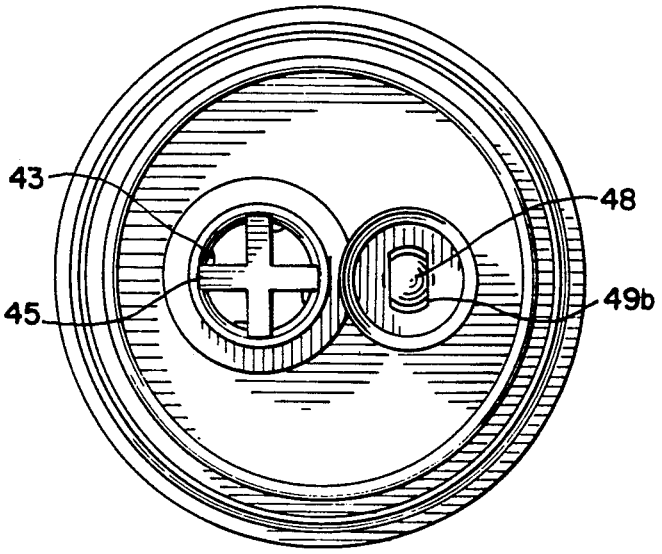
FIG. 5 is a bottom view of the foamer body of the device.

The second restricted conduit is the foam returning passageway 47. The foam returning passageway contains a ball valve 48 which is moveable between the upper opening 49*a* and the lower opening 49*b*. As shown in FIG. 4, the ball valve is in the upper opening. The upper opening is sized so that the ball valve fully seals the opening when in place. In contrast, the lower opening is sized so that the ball valve does not fully seal the opening. The lower opening is best seen in FIG. 5 where it can be seen that the ball valve does not fully seal the rectangular opening.

FIG. 2 shows the lid 50 which serves two primary functions in the device. First, it defines a conduit for the foam between the foamer body and the dispensing spout discussed below. Secondly, it tightens the seal of the foamer body against the reservoir neck. The lid contains threads 51 on its inside surface which mate with the threads on the outside of the neck of the reservoir. A circular ring 52 on the upper inside surface of the lid seats against the foamer body and provides a space communicating with the two restricted conduits of the foamer body and with the vertical passageway portion 53 of the lid. A protruding ring 54 is located just below the upper opening of the lid.

A plug 55 is suspended above the opening by supporting members 56 (only one of which is shown in FIG. 2).

FIG. 2 also shows the cap spout 60 from which the foam is dispensed. The spout portion itself 61 is angled downward at angle $\theta$ for reasons explained below. A protruding ring 62 on the inside of the cap spout engages the protruding ring of the lid. The cap spout is moveable between two positions as shown in FIG. 1.

In the "closed" position, the cap is pressed down upon the lid. The plug fits within a cavity in the roof of the cap to help align the two parts. Seals are provided where the ceiling of the cap rests upon the upper opening of the lid and also where the inner wall of the cap contacts the protruding ring of the lid. In the "open" position, the cap is pulled up as far as possible to the point where the protruding ring of the lid contacts the protruding ring of the cap. The places the spout portion of the cap above the lid's protruding ring adjacent to the opening so that foam can flow up and out through the lid and cap spout.

The operation of the foam dispensing device is as follows. A suitable quantity of a foamable liquid is poured into the liquid reservoir 20. The liquid level in the reservoir should be high enough so that, when the device is assembled, the liquid dip tube 30 reaches the liquid. The liquid level should be low enough so that the inlets to the air channels are not submerged. It is convenient to use a liquid reservoir with a neck sufficiently long that the liquid level can come up to the neck without submerging the air channel inlets. After partially filling the liquid reservoir, the foamer is assembled and is ready for use.

When foam is desired, the device is held in one hand and the cap 60 is moved to the "open" position. The device is usually tipped slightly so that the spout is directed downward into the other hand. The inherent downward slope of the spout 61 reduces the angle to which the reservoir is usually tipped. The angle $\theta$ is generally about 50° to 80°. This reduction in tipping is advantageous because the functioning of the device is impaired if the liquid level rises above an inlet to the air channels 44. The reservoir is then squeezed to dispense foam. The reduction in volume brought about by the squeezing increases the air pressure within the reservoir which, in turn: (1) forces the ball valve 48 up to seal off air flow through the foam return passageway 47; (2) forces a flow of air up through the air channels 44; and (3) forces a flow of liquid up through the dip tube 30. The flowing liquid and air make contact under turbulent conditions just below cross members 45. Additional turbulence is created by the cross members and a foam is formed. If the optional porous screen is present, the foam is homogenized as it passes through the screen. The foam passes upward through the foam conduit interior portion of the lid 50 and cap 60, and out of the device through the spout 61.

When the reservoir is released, the resiliency of the reservoir returns it to its original volume. This increase in volume decreases the air pressure within the reservoir which, in turn: (1) allows the ball valve 48 to drop down to the lower opening 49*b* of the foam return passageway 47, thus opening the passageway; (2) allows the liquid in the dip tube 30 to flow back into the reservoir; (3) allows air to enter the device through the cap spout 61; and (4) causes air and foam from the foam conduit to flow through the foam return passageway 47 to the reservoir. Due to surface tension, a portion of the returned foam may adhere to the bottom of the foam return passageway. But because this foam is sufficiently distant from the inlets to the air channels 44, there is no danger of foam being forced upward through the air channels if the reservoir is immediately squeezed again. Accordingly, the ratio of liquid to air remains constant during rapid, repeated dispensions.

Figure 7:
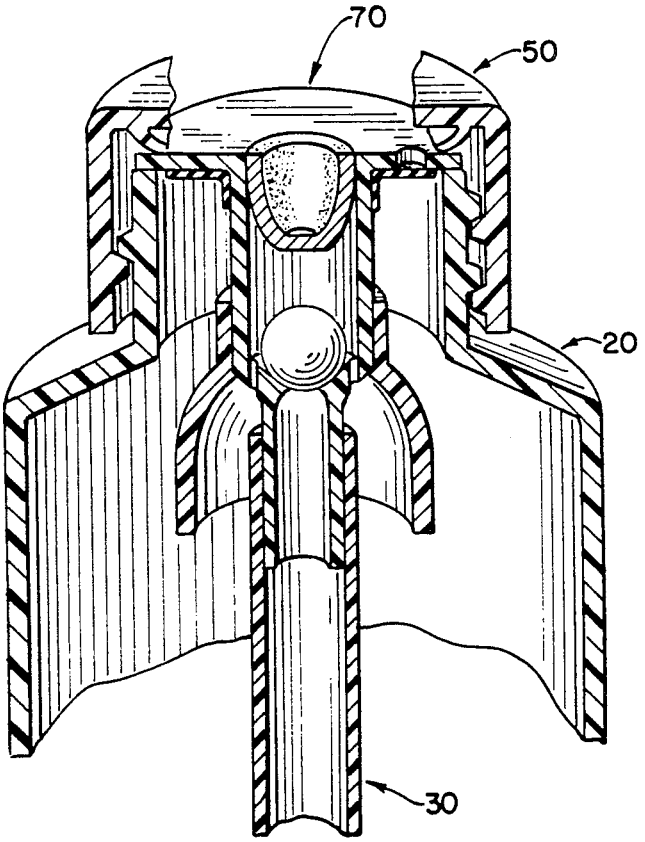
FIG. 7 is a sectional view of a second embodiment of the foamer body of the device.
Figure 8:
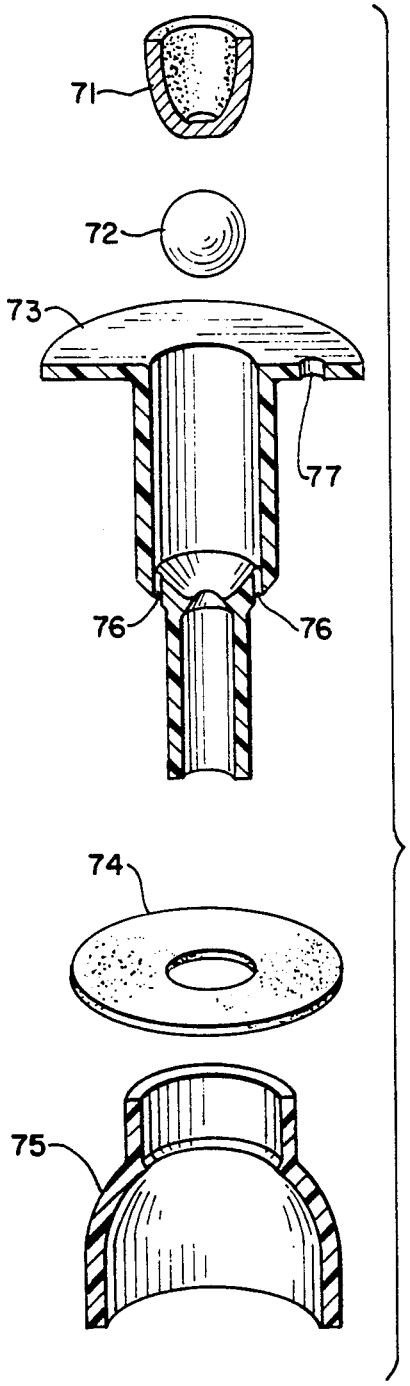
FIG. 8 is an exploded sectional view of the second embodiment of the foamer body.

A second embodiment of the foamer body is shown in FIGS. 7 and 8. The foamer body 70 is shown in position in FIG. 7 resting on the neck portion of the reservoir 20, secured by the lid 50, and connected to the liquid dip tube 30. The foamer body is shown in more detail in the exploded section of FIG. 8. The foamer body comprises a funnel-shaped porous screen 71, a ball valve 72, a mixing chamber 73, a flexible annular ring 74, and a hood 75. All the components of this foamer body are known except for the hood. The mixing chamber contains two air inlets 76 and a foam return passageway 77. The foam return passageway and flexible annular ring make up a flap valve which permits the flow of foam and air only in one direction.

The operation of this embodiment is as follows. When the reservoir is squeezed, the air pressure forces the ball valve up against the porous screen and foamable liquid flows up the dip tube and air flows through the air inlets. Foam is formed in the chamber and is homogenized as it passes upward through the porous screen. The air pressure also forces the flexible annular ring against the foam return passageway, thereby preventing any flow up through this passageway.

When the reservoir is released, the decreased air pressure causes the ball valve to drop down to seal off the liquid dip tube. The decreased air pressure also opens the flap valve and creates a flow of air and foam through the foam return passageway as the flexible annular ring is depressed. The returning foam is shielded from the air inlets by the hood. If the reservoir is immediately squeezed again, no foam is forced upward through the air inlets.

I claim:

1. A foam dispensing device which remains substantially upright as a foamable liquid is mixed with ambient air to form a foam having a relatively constant ratio of liquid-to-air even during rapidly repeated foam dispension, the device comprising:

(a) a compressible reservoir adapted to contain foamable liquid at its bottom and air at its top which supplied air at super-atmospheric pressure when compressed and which replenishes its air supply when released;

(b) a mixing chamber in which the foamable liquid and air from the reservoir mix to form a foam;

(c) means for dispensing the foam from the device;

(d) a conduit for foam from the mixing chamber to the foam dispensing means;

(e) a passage for liquid from the reservoir to the mixing chamber;

(f) a restricted passage for air from the reservoir to the mixing chamber;

(g) a passage for foam return from the foam conduit to the reservoir having one-way valve means to permit flow only in the direction from the foam conduit to the reservoir during operation of the foamer, the passage having a sufficiently short length that its outlet is disposed in the air space at the top of the reservoir to prevent the introduction of foam and air below the level of the foamable liquid at the bottom of the reservoir during rapidly repeated foam dispension; and (h) means for separating the inlet to the restricted air passage from the outlet of the foam return passage to prevent the flow of foam through the restricted air passage during rapidly repeated foam dispension.

2. The device of claim 1 wherein the means of separating the inlet to the restricted air passage from the outlet of the foam return passage comprises a conduit forming part of the foam return passage which extends sufficiently far below the inlet to the restricted air passage to prevent the flow of returned foam into the restricted air passage.

3. The device of claim 2 wherein the one-way valve means in the foam return passage comprises a ball valve.

4. The device of claim 3 additionally comprising a porous screen through which the foam passes before being dispensed.

5. The device of claim 4 wherein the means for dispensing the foam comprises a downwardly-angled spout.

6. The device of claim 1 wherein the means of separating the inlet to the restricted air passage from the outlet of the foam return passage comprises a hood therebetween extending over and sufficiently far below the inlet to the restricted air passage to prevent the flow of returned foam into the restricted air passage.

7. The device of claim 6 wherein the one-way valve means in the foam return passage comprises a flap valve.

8. The device of claim 7 additionally comprising a porous screen through which the foam passes before being dispensed.

9. The device of claim 8 wherein the means for dispensing the foam comprises a downwardly-angled spout.

10. The device of claim 1 wherein the foam return passage has a sufficiently large cross-sectional area that more of the foam returned from the foam conduit to the reservoir flows through the foam return passage than through the restricted air passage.

* * * * *